US005271574A

United States Patent [19]

Formon et al.

[11] Patent Number: 5,271,574

[45] Date of Patent: Dec. 21, 1993

[54] DISPENSER FOR FLEXIBLE SHEET MATERIAL

[75] Inventors: John S. Formon, Marietta; Bruce T. Boone, Acworth, both of Ga.

[73] Assignee: Georgia-Pacific Corporation, Atlanta, Ga.

[21] Appl. No.: 751,064

[22] Filed: Aug. 28, 1991

[51] Int. Cl.[5] ..... B65H 19/00

[52] U.S. Cl. ..... 242/55.3; 242/55.53

[58] Field of Search ..... 242/55.3, 55.53; 312/34.22

[56] References Cited

U.S. PATENT DOCUMENTS

| | | | |
|---|---|---|---|
| 3,387,902 | 6/1968 | Perrin et al. | 312/39 |
| 3,598,331 | 8/1971 | Okamura | 242/55.3 |
| 3,690,580 | 9/1972 | Jespersen | 242/55.3 |
| 3,700,181 | 10/1972 | Diring et al. | 242/55.3 |
| 3,770,222 | 11/1973 | Jespersen | 242/55.3 |
| 3,771,739 | 11/1973 | Nelson | 242/55.3 |
| 4,108,389 | 8/1978 | Womack | 242/55.3 |
| 4,137,805 | 2/1979 | DeLuca et al. | 83/345 |
| 4,142,431 | 3/1979 | Jespersen | 83/335 |
| 4,180,183 | 12/1979 | Muller | 221/194 |
| 4,206,858 | 6/1980 | DeLuca et al. | 225/96 |
| 4,340,195 | 7/1982 | DeLuca | 242/55.3 |
| 4,844,361 | 7/1989 | Granger | 242/55.3 |
| 4,856,724 | 8/1989 | Jespersen | 242/55.3 |
| 4,944,466 | 7/1990 | Jespersen | 242/55.3 |
| 5,000,393 | 3/1991 | Madsen | 242/55.3 |

*Primary Examiner*—Daniel P. Stodola
*Assistant Examiner*—John P. Darling
*Attorney, Agent, or Firm*—Banner, Birch, McKie and Beckett

[57] ABSTRACT

A dispenser for flexible sheet material rolls in which a first roll is supported in a dispensing position, a second roll is supported in a reserve position and a roll transfer apparatus is operative to transfer the second roll to the dispensing position upon depletion of sheet material from the first roll with the supporting arrangement for the roll in the dispensing postion being rotatable with such roll and thereby subject to significantly reduced friction effects. The described dispenser organization also includes a novel arrangement for retaining the cores and spindles of spent rolls within the dispenser until the closure cover is opened for replenishing the dispenser with fresh rolls whereupon, by opening the cover, the spent residual roll elements are automatically deposited into the opened cover that forms a receptacle from whence the elements can be retrieved for disposal and following which the dispenser organization is automatically returned to its operative condition in a single step upon simply closing the closure cover.

31 Claims, 5 Drawing Sheets 28
40
10
36
35
16
74
76
18
58
62
14
24
20
32
34
38
58
108
37
12
66
68
54
86
88
78
77
29
93
100
98
104
106
50
110
108

DISPENSER FOR FLEXIBLE SHEET MATERIAL

BACKGROUND OF THE INVENTION

This invention relates to dispensers for flexible sheet material, such as toilet tissue, in which a reserve roll is automatically movable from its stored position into a dispensing position upon disipation of sheet material from the supply roll, and for means for conveniently storing the residual portions of disipated rolls and their removal upon opening of the dispenser cover.

Flexible sheet material dispenser devices having the capability of moving a reserve roll into a sheet dispensing position upon disipation of sheet material from the original supply roll, are known. One such example is described in U.S. Pat. No. 3,770,222 granted Nov. 6, 1973 to Paul W. Jespersen and assigned to the assignee hereof. The device shown in this patent, while being relatively simple in design and effective in operation, suffers from certain disadvantages. For example, the patented dispenser organization relies for support of the supply roll upon the wall of the dispenser cabinet thereby increasing to a significant extent the undesirable effects of friction on the operation. Deriving support of the supply roll by its continual contact with the cabinet wall not only adds to the amount of force required to be imparted by a user in withdrawing sheet material from the dispenser, it also creates the danger of damage to the delicate sheet material being dispensed caused by the erosive effects of the material rubbing against the wall surface as the supply roll rotates during the withdrawal of sheet material.

Another deleterious characteristic of prior art devices of the concerned type is that, commonly, the residual elements of the spent supply rolls, namely the core and spindle end caps therefor, are discharged by simply being permitted to fall from the open bottom of the dispenser and thus become an eyesore to the environs of the dispenser. Where the problem has been addressed, the solutions proposed involving closing the bottom of the dispenser to form a collection compartment is less than totally satisfactory due to the problem of gaining access to the elements for ultimate disposal.

It is to the amelioration of the above problems, therefore, to which the present invention is directed.

SUMMARY OF THE INVENTION

Therefore, there is provided according to one aspect of the invention a dispenser for a plurality of dispensing rolls of flexible sheet material comprising a chassis; a dispensing roll transfer structure including means forming opposed guide channels on opposite sides of said chassis operative to receive the axial ends of a first dispensing roll in a sheet-dispensing position and a second dispensing roll in a reverse position thereabove, both said dispensing rolls being movable downwardly in said guide channels by gravity; a dispensing roll support extending between opposite sides of said chassis for vertically supporting a dispensing roll in its sheet-dispensing position; said guide channel-forming means including a guide track member mounted for pivotal movement between a support position for vertically supporting said second roll when said first roll is in a sheet-dispensing condition and a release position in which said second roll is released for movement to said paper-dispensing position when said first dispensing rolls is in a depleted condition.

Support provided for the sheet dispensing roll in its dispensing position is derived from a rotatable gauging roll which is effective to reduce the friction effects caused by the roll-support device and which is formed with a surface projection that acts on the roll as it rotates so as to relieve the problem of looping of the sheet material which is attendant to dispensers of the concerned type.

Furthermore, the guide channels formed by the cooperation between the fixed and the movable guide track members are so arranged as to automatically induce movement of the dispensing roll in the direction of the dispenser opening as the diameter of the roll is diminished in order to facilitate user access to the leading end of the material.

According to another aspect of the present invention there is provided a dispenser for sheet material wound on dispensing rolls having residual elements and incorporating means for disposal of such elements following disipation of said sheet material from said rolls, said dispenser comprising a chassis having a dispensing roll transfer structure from which residual elements of disipated dispensing rolls are discharged, when spent; means forming a compartment in the bottom of said chassis for receiving said residual roll elements; a door operably connected to said chassis for releasably closing said compartment; a cover pivotally attached to said chassis for movement between an open and a closed position thereon; releasable latch means for holding said door in its compartment-closing condition; and means for automatically releasing said latch means for opening said door upon moving said cover to its open position.

Automatic release of the compartment-closing door is afforded by the cooperative relative dispositions of the pivotally mounted door and dispenser cover whereby the cover, in pivoting to its open position, as for example for replenishing the dispensing rolls therein, is caused to so engage the door as to effect the release of the latching mechanism whereupon the door is caused to open and discharge the residual roll core and spindle elements from the compartment.

Moreover, due to the rectangular box-like shape assumed by the dispenser cover in its inverted condition when opened, the residual roll elements in dropping from the opening door are readily received in the cover from whence they can be retrieved for disposal.

Also, the dispenser cover is configured and arranged with respect to the door as to automatically effect closure and relatching of the door when the cover is returned to its closed condition.

In view of the foregoing it is a principal object of the present invention to provide an improved dispenser for flexible sheet material rolls.

It is also an object of the invention to provide an improved, less friction-sensitive sheet material dispenser of the type in which a reserve roll is automatically transferred to the dispensing position upon depletion of the original supply roll.

It is a further object of the invention to provide a dispenser of the described type in which the residual cores and spindles from depleted rolls can be stored within the dispenser and conveniently released therefrom for retrieval upon opening the dispenser cover to replenish the roll supply.

These and other objects of the invention will be apparent upon consideration of the following detailed description of a preferred embodiment thereof presented in connection with the following drawings in which like reference numerals identify like elements throughout.

DETAILED DESCRIPTION OF THE PREFERRED EMBODIMENT

Figure 1:
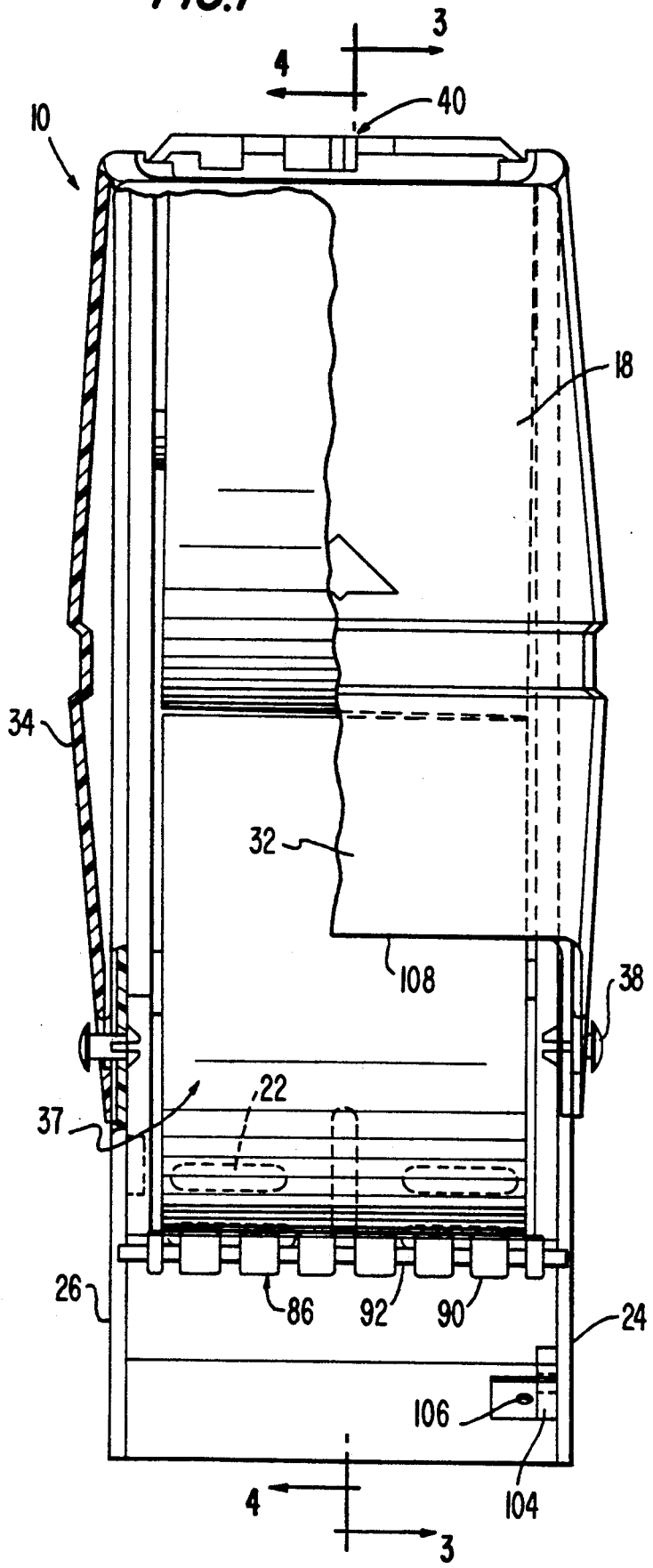
FIG. 1 is a front elevational partial view of a dispenser for flexible sheet material constructed according to the present invention.

The drawings illustrate a dispenser, indicated generally by the reference numeral 10, for flexible sheet material that is wound on dispensing rolls, here designated, for the sake of description, as supply roll 12 and reserve roll 14.

Dispenser 10 is formed principally of molded plastic construction and includes a cabinet structure formed by a chassis 16 and a closure cover 18. Chassis 16 comprises a back wall 20 containing appropriately positioned mounting holes 22 (only two of which are depicted in the drawing figures) for attaching the dispenser to an upstanding building structure and oppositely spaced side walls 24 and 26 projecting forwardly from the back wall. The top of the chassis 16 contains a forwardly projecting support element 28 interconnecting the upper ends of the back wall 20 and side walls 24 and 26 and a brace 29 extends between and laterally supports the side walls adjacent the chassis lower end.

The interior of the dispenser 10 is closed by the closure cover 18 having generally rectangularly disposed front, side and top walls 32, 34 and 36, respectively. The back and bottom ends of the cover are open. As shown, the lower end of the respective cover walls are spaced from the bottom of the chassis 16 to define a sheet dispensing opening 37 to enable access by a user of the leading end of flexible sheet material from a dispensing roll, such as the supply roll 12 when in its dispensing position. The cover 18 is connected by pivot pins 38 that extend through openings formed at the back of the lower ends of the cover side walls 34 and that attach to the respective side walls 24 and 26 of the chassis 16 so that the cover can be rotated between a closed position, as presented by the solid line illustration in FIG. 4, and an angularly displaced open position, as depicted by the dash lines in the drawing figure.

A releasable locking mechanism 40, of generally well known construction, is provided for locking the cover 18 in its closed condition to the chassis 16. It includes a fixed latch element 42 integrally formed on the support element 28 and a movable metal plate 44 cooperable therewith and pivotally secured to a metal mounting plate 35 at the top end of the cover to form the cover top wall 36 for operation by a key 46, or the like. It will be appreciated that when the cover is closed and its top wall 36 snugly received over the chassis support element 28, a hook-like latch member 48 formed on the plate 44 is caused by a spring bias on the plate to be placed in locking engagement with a cooperating latch member 42 integrally formed on the support element 28. At the bottom end of the chassis 16 there is formed a compartment 78 that is closed by a pivotally mounted closure door, indicated generally at 50, the structure and function of which are described in detail hereinafter.

Figure 5:
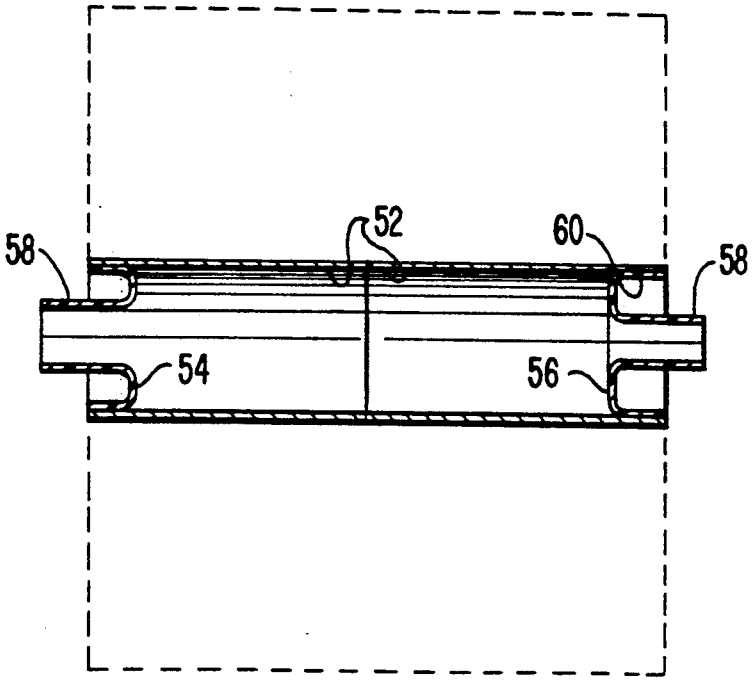
FIG. 5 is a sectional elevational view of a dispensing roll for use with the dispenser of FIG. 1.

Dispenser 10 is adapted to dispense flexible sheet material, as for example, toilet tissue or the like, from dispensing rolls, such as those shown at 12 and 14 in the drawing figures. As shown best in FIG. 5, the rolls 12, 14 each include a hollow, split cylindrical cardboard core formed by core segments 52 about which the sheet material is wound. A spindle means is formed by trunnions 54 and 56 that extend axially outwardly from the respective core segments 52. The trunnions, which are formed of a plastic material, each comprise an axial shaft portion 58 adapted to cooperate with guide channels 62 and 64, hereinafter described, and a retaining flange 60 adapted for friction retention of the spindles in the core segments 52.

The dispenser 10 contains a dispensing roll transfer structure that comprises generally vertically elongated, oppositely facing, open ended guide channels 62 and 64 formed on the respective side walls 24 and 26 of chassis 16 and adapted to receive the axially extending shaft portions 58 of the trunnions 54 and 56 of the supply and reserve rolls 12 and 14. Each of the guide channels 62 and 64 are formed by track members that are mutually spaced to receive the trunnion shaft portions for guided movement of the respective dispensing rolls 12 and 14, as hereinafter described. Guide channel 62 on side wall 24 is shown as being formed of a pair of integrally formed, fixed guide track members 66 and 68 and adapted to guidingly receive the smaller diameter shaft portions of trunnions 54 of the respective rolls. Guide channel 64 on side wall 26 which receives the larger diameter shaft portion of trunnions 56, on the other hand, is formed by a forwardly positioned, integrally formed, fixed guide track member 70 that cooperates with a movable guide track member 72 that operates as a roll transfer lever.

The openings 74 at the upper ends of the respective guide channels 62 and 64 are caused to diverge by the inclusion on the forward-most track members 66 and 70 of the respective guide channels 62 and 64 of the divergent flange portions 76 to facilitate loading of dispensing rolls into the roll transfer structure. Openings 77 at the bottom end of the guide channels 62 and 64 are positioned to discharge the residual roll elements which include the core 52 and trunnions 54, 56 of spent rolls into a compartment region, indicated as 78, in the dispenser bottom.

The movable track member, or transfer lever 72, is mounted to the chassis side wall 26 by a pivot pin 80 that permits front-to-rear pivotal movement of the member. A motion stop 82 comprising an integrally formed projection from the side wall 26 serves to limit the extent of movement of the transfer lever 72 in a counter-clockwise direction. The pivot pin 80 is preferably located in an off-center position along the length of the transfer lever 72 to impart thereto a normal counter-clockwise bias disposing the lever lower end of the lever against the stop 82.

The upper end 84 of the transfer lever 72 is adapted to engage and vertically support the spindle shaft 58 of the trunnion 56 of the dispensing roll 14 in the reserve position. As shown, the end of the lever 72 is formed as a downwardly inclined arcuate surface 83 in order to enable the engaged trunnion shaft to urge the lever clockwise to displace its upper end rearwardly when the lever is free to pivot.

Figure 2:
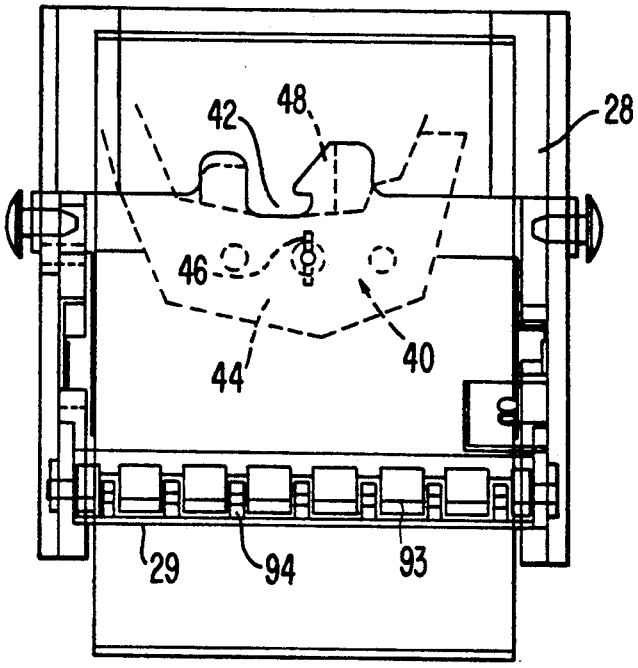
FIG. 2 is a top plan view of the dispenser of FIG. 1 shown with the closure cover removed.

A roll-support member is provided to vertically support the supply roll 12. Such member is in the form of gauging roll 86 that extends transversely of the chassis 16 between journal mounts 88 (FIGS. 3 and 4) provided on the respective side walls by means of which the gauging roll is permitted to rotate. As shown in FIGS. 1 and 4 the gauging roll 86 is formed of alternating large diameter portions 90 and small diameter portions 92. The surfaces of the large diameter portions 90, which engage the supply roll 12 when in its dispensing position, have formed thereon radial projections 93 that serve to intermittently displace, or bounce, the roll when sheet material is being dispensed therefrom by a user. In this way, any looping or sag as may occur in the outer winding of sheet material on the dispensing roll adjacent the gauging roll can be taken up by tension applied to the sheet material by the user when the dispensing roll is intermittently out of contact with the gauging roll. Preferably, stripper arms 94 (FIG. 2) extend from the interior surface of the brace 29 into the spaces created by the small diameter portions 92 of the gauging roll 86 so as to prevent adherence of the free end of the sheet material on the dispensing roll to the adjacent winding.

To load the dispenser, closure cover 18 is opened and the shaft portions 58 of trunnions 54 and 56 of the flexible sheet dispensing roll, identified as supply roll 12, are inserted into the upper ends 74 of the respective guide channels 62 and 64. It will be appreciated that, because the width of the respective guide channels 62 and 64 correspond to the diameter of the respective trunnion shaft portions, all of the rolls will be installed in the dispenser uniformly with the sheet material winding occurring identically on each roll, thus to insure the extension of the leading end of the material from all rolls from the sheet dispensing opening 37 for access by a user.

The dispensing roll 12 gravitates downwardly along the guide channels 62 and 64 until the outer peripheral surface formed by the wound material thereon engages the gauging roll 86 whereby the roll is disposed in its sheet dispensing position. With the roll 12 in this position, its spindle shaft 58 on trunnion 56 is caused to engage the adjacent edge of the lower end 85 transfer lever 72 to urge this end of the lever counter-clockwise against the stop 82. With the lever lower end 85 disposed against the stop 82 the upper end 84 is moved to a position that obstructs the upper end of guide channel 64. Consequently, when placed in the dispenser 10, the reserve roll 14 is retained with the spindle shafts 58 of its trunnions 54 and 56 held at the upper ends of the respective guide channels 62 and 64 due to the supported engagement of trunnion 56 by the upper end surface 83 of the transfer lever 72.

As sheet material is consumed from supply roll 12, the spindle shafts 58 on trunnions 54 and 56 on this roll move downwardly along the respective guide channels 62 and 64 with the periphery of the roll being continually supported by the gauging roll 86. Due to the forwardly curved configuration of the respective guide channels 62 and 64 in the regions indicated as 96 adjacent the lower ends of the channels, the supply roll 12, as sheet material is dispensed therefrom, is displaced toward the dispensing opening 37 thus to continually maintain the free end of the sheet material externally of the dispensing opening and within easy access by a user.

The relative dimensions and positioning of the gauging roll 86 and facing edge of the lower end 85 of transfer lever 72 is such that, for so long as sheet material remains on the core 52 of the supply roll 12, the spindle shaft 58 on the trunnion 56 thereof is caused to urge the transfer lever 72 against the stop 82 and, concomitantly, the upper end 84 of the transfer lever in supporting and obstructing engagement with the spindle shaft 58 of the reserve roll trunnion 56. Upon depletion of sheet material from the supply roll 12, the residual elements thereof; namely, core segments 52 with the retained trunnions 54 and 56, are free to fall by gravity from the open lower ends of the guide channels 62 and 64 and into the compartment 78 formed at the bottom of the chassis. Passing of the residual roll elements from the guide channels, and particularly of the spindle shaft 58 of trunnion 56 from between the gauging roll 86 and forward edge of the lower end of the transfer lever 72, leaves the lower end of the guide channel 64 free to accept the inward or clockwise movement of the transfer lever lower end. Therefore, due to the action of the spindle shaft 58 of the reserve roll trunnion 56 on the inclined end surface 84 of the upper end of the transfer lever 72, the lever is caused to pivot clockwise so that the upper end is moved from its channel-obstructing position, and the reserve roll 14 accordingly falls by gravity to the sheet dispensing position originally filled by the supply roll 12 and dispensing of sheet material by a user.

According to the other aspect of the invention, the bottom of the chassis 16 is formed with a releasable door 50 which retains the residual elements, such as core segments 52 and trunnions 54 and 56 from the disipated roll or rolls that fall from the guide channels 62 and 64 into the compartment 78. The door 50 is formed by a contoured plate 98 formed of plastic material that extends transversely across the width of the chassis 16 between the side walls 24 and 26 thereof. The door plate 98 is pivoted about a horizontal axis by means of pivot pins 100 integrally formed on the upper surface of the plate intermediate the forward and rearward ends thereof. Pins 100 are journalled for pivotal movement in bearing mounts 102 formed in the respective side walls 24 and 26.

The door plate 98 is held in its closed position by a releasable latching device that is preferably formed by a magnet member 104 fixed to the inner surface of side wall 24 for cooperation with a magnetically-responsive metal plate 106 that is fixedly secured to the interior surface of the door plate 98. The opposite lateral end of the door plate is positioned by means of a stop 107 integrally formed on the chassis side wall 26.

The door 50 is adapted to be opened automatically upon opening of the closure cover 18 and, conversely, to be closed automatically upon returning the cover to its closed position. Thus, with particular reference to FIG. 3, it is apparent that, when the dispenser closure cover 18 is pivotally moved to its open position; the lower end, indicated as 108, of the cover front wall 32 is caused to engage the door plate 98 rearwardly of the pivot pins 100 whereby the front end of the door plate carrying metal plate 106 is moved sufficiently away from the magnet member 104 to release the attraction between the magnet and the metal plate. When this magnetic connection is broken, the door plate 98 is free to rotate by gravity in a clockwise direction under the unblanced weight of the door plate and, particularly, as the unbalanced weight is supplemented by any residual roll elements that may be housed in the compartment 78 resting on the interior surface of the door plate.

Figure 3:
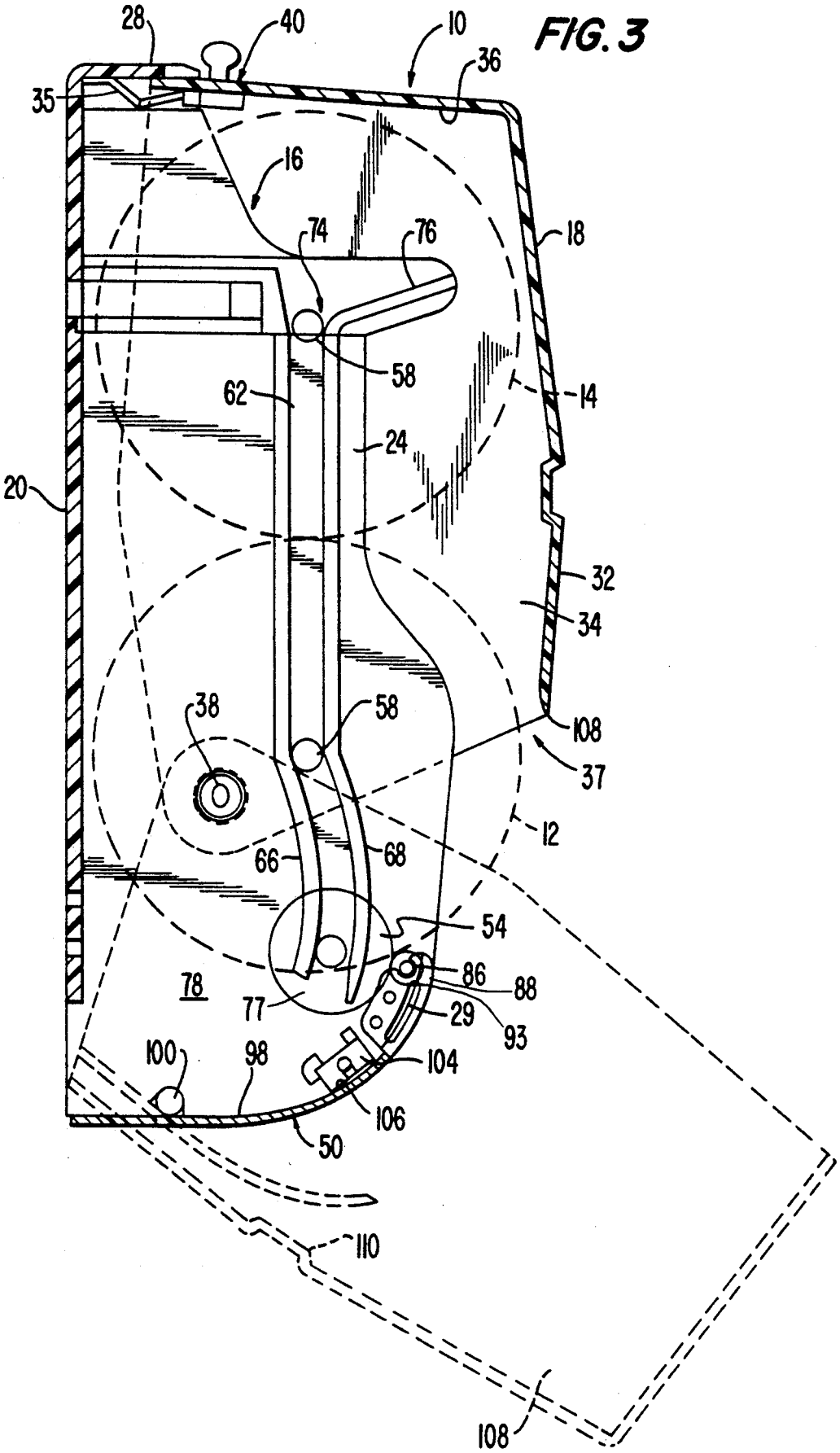
FIG. 3 is a side sectional elevation view taken along line 3—3 of FIG. 1 and showing the closure cover and compartment door in their closed and open conditions.
Figure 4:
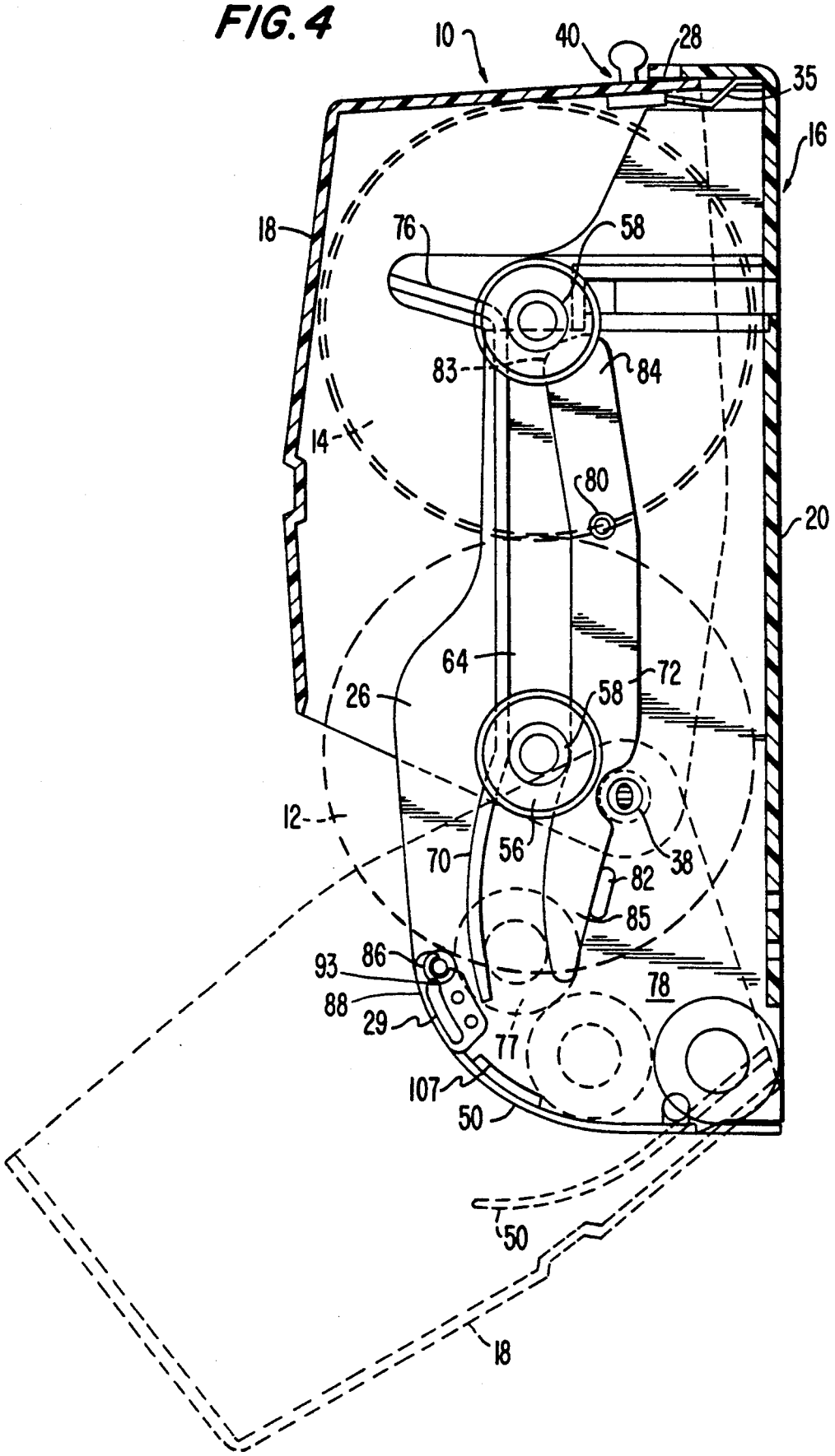
FIG. 4 is a side sectional elevation view taken along line 4—4 of FIG. 1.

As best shown by the phantom line representations in FIG. 3, the closure cover 18, in its inverted open condition disposes the rectangularly arranged front, side and top walls, 32 to 36, to conveniently form a receptacle 108 into which any residual roll elements discharged from compartment 78 through the opened door 50 will fall and from whence they can be readily retrieved for disposal.

Advantageously, as indicated above, the door 50 is returned to its closed, latched condition upon closure of the cover 18 by the wiping action imposed on the facing surface of the door plate 98 by the cover lower end 108. Thus, as the cover 18 is angularly displaced counterclockwise toward its closed condition, the end 108 wipingly engages the door plate 90 forwardly of the pivot pins 100 to urge it in a counterclockwise direction to a point that the metal actuating plate 106 is placed sufficiently close to the magnet 104 to be magnetically latched thereby.

Accordingly, it will be appreciated that the present invention provides a dispenser for flexible sheet material that is simple in design and inexpensive in cost, as compared with similar apparatus known in the prior art. Moreover, the herein-described dispenser is advantageously capable of providing a substantially friction-free delivery of sheet material from the supply roll without any cost to the effectiveness of ability of a reserve roll to be tranferred to the dispensing position upon depletion of material from the supply roll.

Also, the invention further provides an effective manner of retaining the residual portions of spent rolls within the dispenser until the closure cover is opened, as, for example, to replenish the dispenser with fresh rolls. As a result of the relative organization of the dispenser compartment door and the closure cover, a workman, by simply opening the closure cover can automatically release such residual portions from the dispenser compartment into a receptacle formed by the closure cover whereby they can be readily retrieved for disposal. Conversely, return of the dispenser organization to its operative condition is automatically achieved in one step by the workman's simply closing the cover after replenishing the dispenser with fresh rolls.

Figure 6:
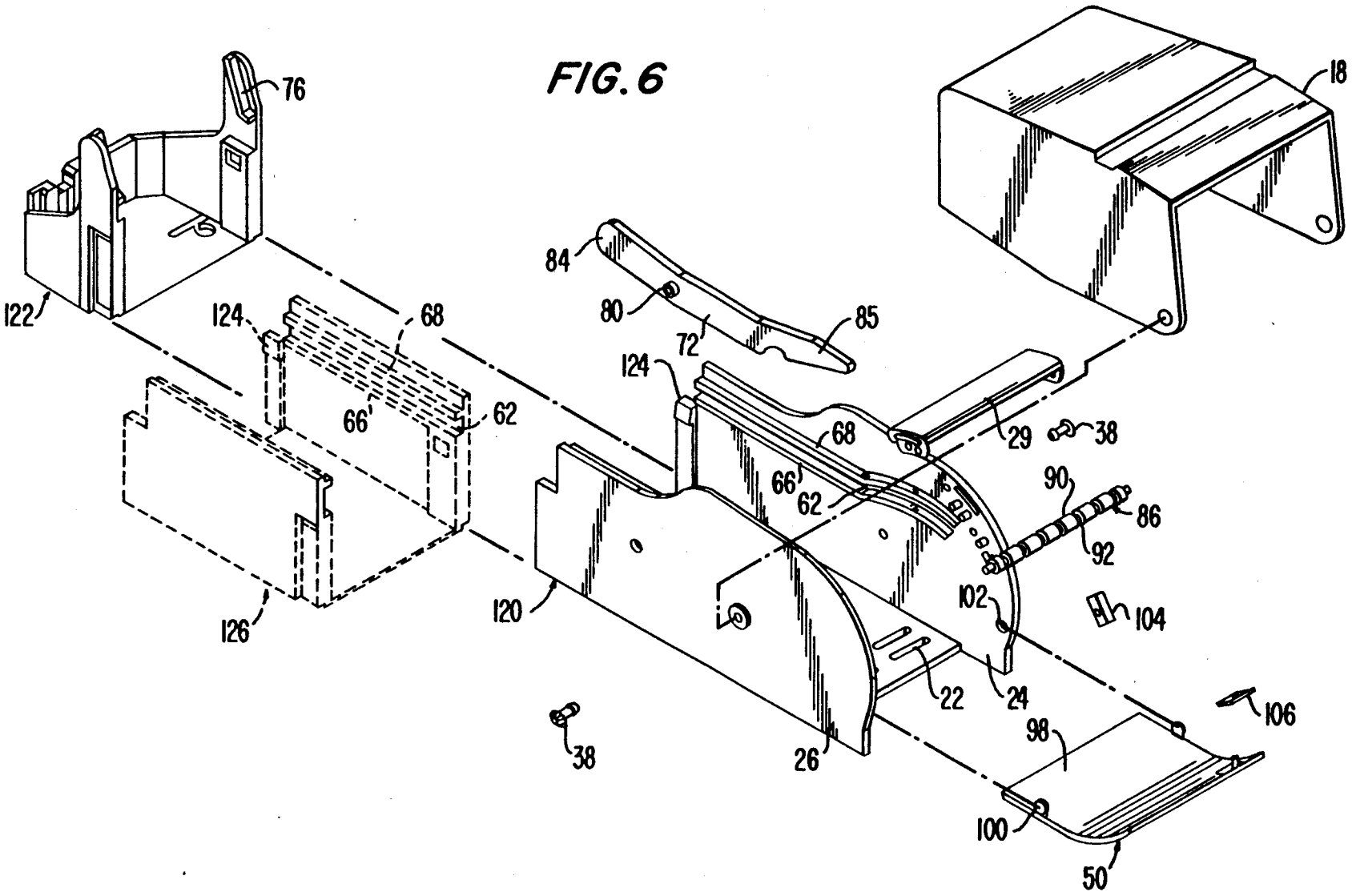
FIG. 6 is an exploded, perspective view of the dispenser of FIG. 1.

Furthermore, the described apparatus design readily lends itself to expansion into a dispenser for holding two flexible sheet material dispensing rolls in reserve while one roll is disposed in the dispensing position. Thus, as shown by FIGS. 3, 4 and 6, the above-described chassis 16 can be formed by a main chassis segment 120 and a top segment 122 that are interconnected by aggressive snap-fit connections 124, of known design. Alternatively, to impart to the dispenser 10 the capability of holding an additional dispensing roll in reserve there need be added only the structure, termed the middle adapter, shown in phantom at 126 in FIG. 6 that is arranged for locked installation by similar snap fit connections 124 having the same configuration as the corresponding segments used for a two roll installation intermediate the main chassis segment 120 and top segment 122. Beyond this, the only other change required is the use of a closure cover 18 having an increased length sufficient to accommodate the interposition of the middle adapter 126 between the main chassis and top segments 120 and 122 respectively.

While particular embodiments of the invention have been shown and described, it is recognized that various modifications thereof will occur to those skilled in the art. Therefore, the scope of the herein-described invention shall be limited solely by the scope of the claims appended hereto.

We claim:

1. A dispenser for a plurality of dispensing rolls of flexible sheet material comprising:

a chassis;

a dispensing roll transfer structure including means forming opposed guide channels on opposite sides of said chassis operative to receive the axial ends of a first dispensing roll in a sheet-dispensing position and a second dispensing roll in a reserve position thereabove, both said dispensing rolls being movable by gravity downwardly in said guide channels;

said guide channel-forming means including a guide track member mounted for pivotal movement between a support position for vertically supporting said second roll when said first roll is in a sheet-dispensing condition and a release position in which said second roll is released for movement to said sheet-dispensing position when said first dispensing roll is in a depleted condition; and a gauging roll extending between opposite sides of said chassis substantially parallel to the axis of said dispensing rolls, said gauging roll being journalled for rotation on a substantially fixed axis and being disposed with respect to said guide channel-forming means to engage only a dispensing roll in its sheet material dispensing position to provide vertical support therefor when said dispensing roll contains sheet material thereon and to permit passage of the supported dispensing roll from said guide channel forming means when said sheet material is depleted therefrom.

2. A dispenser according to claim 1 including means forming a projection extending from the peripheral surface of said gauging roll for intermittently displacing a dispensing roll supported thereby.

3. A dispenser according to claim 1 including stripping means cooperable with said gauging roll for directing sheet material outwardly from said dispensing roll.

4. A dispenser according to claim 1 in which each of said dispensing rolls have spindle means extending axially beyond the ends thereof for reception in said guide channels.

5. A dispenser according to claim 4 in which said movable guide track member includes means at the upper end thereof for supportingly engaging said spindle means on said second roll in said support position.

6. A dispenser according to claim 5 including means for normally biasing said movable guide track member toward said release position.

7. A dispenser according to claim 6 in which said biasing means comprises a pivot pin disposed in off-center relation to the length of said movable guide track member for pivotally mounting said movable guide track member with respect to said chassis.

8. A dispenser according to claim 7 including a stop fixedly secured with respect to said chassis for limiting the extent of pivotal movement of said movable guide track member.

9. A dispenser according to claim 4 in which said spindle means on opposite ends of said dispensing rolls are formed of different diameters.

10. A dispenser according to claim 1 in which said chassis includes a dispensing opening on one side thereof and said guide channels in the region of said sheet dispensing position are formed to induce movement of a sheet dispensing roll laterally toward said dispensing opening as sheet material in dispensed from said dispensing roll.

11. A dispenser according to claim 10 in which said opposed guide channels in the region of said sheet dispensing position are arcuately curved in the direction of said dispensing opening.

12. A dispenser according to claim 1 in which said guide channels in said dispensing roll transfer structure are formed by a pair of spaced, fixedly attached guide track members on one side of said chassis and a fixed guide track member cooperating with said movable guide track member on the other side thereof.

13. A dispenser according to claim 12 in which said spindle means on opposite ends of said dispensing rolls are formed of different diameters, said spindle means for reception in said guide channel formed by said fixed guide track members being of less diameter than that of said spindle means for reception in said guide channel on the other side of said chassis.

14. A dispenser for a plurality of dispensing rolls of flexible sheet material having spindle means extending beyond opposite ends thereof, comprising:

a chassis having a sheet dispensing opening in one face thereof;

a dispensing roll transfer structure including mutually spaced guide track members forming substantially vertically extending, open ended guide channels on opposite sides of said chassis for reception of said spindle means and for gravitationally induced guided movement therealong between an elevated reserve position and a subjacent sheet-dispensing position; and a gauging roll extending between opposite sides of said chassis substantially parallel to the axis of said dispensing rolls, said gauging roll being journalled for rotation on a substantially fixed axis and being disposed with respect to said guide channel-forming means to engage only a dispensing roll in its sheet material dispensing position to provide vertical support therefor when said dispensing roll contains sheet material thereon and to permit passage of the supported dispensing roll from said guide channel forming means when said sheet material is depleted therefrom;

at least one of said guide track members being mounted for pivotal movement to place the upper end thereof in a position of subjacent vertically supporting engagement with a spindle means of a dispensing roll in said reserve position when said spindle means of said dispensing roll is retained in said sheet dispensing position by said gauging roll and a release position displaced from said position of engagement when said spindle means of said dispensing roll moves by gravity from said sheet dispensing position to fall from the open lower ends of said guide channels.

15. A dispenser according to claim 14 in which said guide track members forming said guide channels in the region of said sheet-dispensing position are arcuately deviated from a vertical attitude to induce movement of a sheet dispensing roll toward said dispensing opening as sheet material is dispensed from said dispensing roll.

16. A dispenser according to claim 14 including a closure cover movably attached to said chassis and in which said chassis contains a compartment beneath the lower ends of said guide channels for receiving residual portions of said dissipated dispensing rolls; a door movable independently of movement of said closure cover operably connected to said chassis for releasably closing said compartment; a releasable latch operable for holding said door in its compartment-closing condition; and means on said closure cover for actuating said latch to a released condition for opening said door for removal of said residual portions.

17. A dispenser according to claim 16 in which said closure cover is pivotally attached to said chassis for movement between an open and a closed position thereon; and cam means on said cover engageable with said door, when closed, for automatically releasing said latch for opening said door upon moving said closure cover toward its open position.

18. A dispenser according to claim 17 further including second cam means on said cover engageable with said door, when open, for automatically actuating said latch to close said door upon moving said closure cover toward its closed position.

19. A dispenser according to claim 18 in which said door is pivotable about a substantially horizontal axis extending across the bottom of said compartment and in which said closure cover is pivotable about an axis substantially parallel to, and spaced from, the pivot axis of said door, said first cam means on said closure cover defining door-engaging means operable to release said latch to open said door upon contacting said door when said closure cover moves from its closed position toward its open position and said second cam means on said closure cover defining door-engaging means operable to activate said latch to a closed condition when said closure cover is moved toward its closed position.

20. A dispenser according to claim 19 in which said closure cover has substantially rectangularly disposed sides defining a retainer in its inverted, open position and in which the cooperative association between said door and said closure cover in their respective open conditions effects gravity discharge of said residual elements from said compartment into the retainer formed by said inverted closure cover.

21. A dispenser according to claim 16 in which said releasable latch is magnetic.

22. A dispenser for sheet material from dispensing rolls having residual elements for disposal following dissipation of said sheet material from said rolls, said dispenser comprising:

a chassis having a dispensing roll transfer structure from which residual elements of dissipated dispensing rolls are discharged, when spent;

means forming a compartment in the bottom of said chassis for receiving said discharged residual roll elements;

a closure cover pivotally attached to said chassis for movement between an open and a closed position thereon;

a door movable independently of movement of said closure cover operably connected to said chassis for releasably closing said compartment;

a releasable latch for holding said door in its compartment-closing condition; and first means on said closure cover for impacting said door to release said latch for opening said door upon moving said closure cover to its open position.

23. A dispenser according to claim 22 further including second means on said closure cover separate from said first means engageable with said door for urging said door to a latched condition upon moving said closure cover toward its closed position.

24. A dispenser according to claim 23 in which said door is pivotable about a substantially horizontal axis extending across the bottom of said compartment and in which said closure cover pivots about an axis substantially parallel to, and spaced from, the pivot axis of said door, said closure cover having first door-engaging cam means operable to release said latch upon contacting said door to effect opening of said compartment for removal of said residual elements therefrom.

25. A dispenser according to claim 24 in which said closure cover includes second door-engaging cam means operable to contact said door and to pivot it into latched relation with said latch as said cover is moved toward its closed position.

26. A dispenser according to claim 24 in which said closure cover has substantially rectangularly disposed sides defining a retainer in its inverted, open position and in which the relative disposition between said door and said cover in their respective open conditions effects gravity discharge of said residual elements from said compartment into the retainer formed by said inverted cover.

27. A method for dispensing sheet material in a dispenser from rolls in which said sheet material is wound on a core, said dispenser including a movable closure cover enclosing said rolls and a collection area closed by releasably latched door movable independently of the movement of the closure cover, comprising the steps of:

supporting a first roll in a dispensing position and a second roll in a reserve position;

dispensing sheet material from said first roll;

upon depletion of sheet material from said first roll, releasing the core thereof to a collection area and said second roll to said dispensing position;

dispensing sheet material from said second roll;

upon depletion of sheet material from said second roll releasing the core thereof to said collection area in said dispenser; and moving said closure cover toward a position for replenishing said rolls and thereby impacting said door for releasing a latched connection between said door and said dispenser to effect movement of said door to an open condition for discharging said cores from said collection area.

28. A method according to claim 27 including the step of discharging said cores from said collection area by gravity.

29. A method according to claim 27 including the step of moving said closure cover to an inverted position beneath said door and receiving therein said cores discharged from said collection area.

30. A method according to claim 27 including the step of automatically urging said door to its latched condition by the contact of said door by said closure cover while returning said closure cover toward a position enclosing said replenished rolls in said dispenser.

31. A method according to claim 30 in which said closure cover, in returning to its roll-enclosing position wipingly contacts said door and directs it to its latched condition.

* * * * *